US009482187B2

(12) United States Patent
Cloos et al.

(10) Patent No.: US 9,482,187 B2
(45) Date of Patent: Nov. 1, 2016

(54) EXHAUST GAS RECIRCULATION DEVICE FOR A MOTOR VEHICLE

(71) Applicant: GM GLOBAL TECHNOLOGY OPERATIONS LLC, Detroit, MI (US)

(72) Inventors: Lutz Kilian Cloos, Weinheim (DE); Gerwin Tittes, Trebur (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 247 days.

(21) Appl. No.: 14/194,135

(22) Filed: Feb. 28, 2014

(65) Prior Publication Data

US 2014/0246000 A1 Sep. 4, 2014

(30) Foreign Application Priority Data

Mar. 1, 2013 (DE) ..... 10 2013 003 458

(51) Int. Cl.
*F02M 25/07* (2006.01)

(52) U.S. Cl.
CPC ..... *F02M 25/0721* (2013.01); *F02M 26/19* (2016.02)

(58) Field of Classification Search
CPC ..... F02M 25/07; F02M 25/0703; F02M 25/0722; F02M 25/0721; F02M 26/19; F02M 26/17
See application file for complete search history.

(56) References Cited

U.S. PATENT DOCUMENTS

2003/0115871 A1 6/2003 Feucht et al.
2003/0226552 A1* 12/2003 Hewkin ..... F02M 25/0721 123/568.11
2008/0134678 A1* 6/2008 Noelle ..... F01D 25/24 60/605.2
2012/0204845 A1* 8/2012 Gingrich ..... F02M 25/0707 123/568.17

* cited by examiner

*Primary Examiner* — Lindsay Low
*Assistant Examiner* — Jacob Amick
(74) *Attorney, Agent, or Firm* — Lorenz & Kopf LLP

(57) ABSTRACT

An exhaust gas recirculation device for a motor vehicle is disclosed with includes an unburnt gas line for guiding an unburnt gas flow and at least one exhaust gas feed line for supplying exhaust gas into the unburnt gas line. At least two discharge openings offset relative to each other in the circumferential direction of the unburnt gas line are provided in the unburnt gas line, by way of which the exhaust gas can be or is supplied to the unburnt gas line.

18 Claims, 1 Drawing Sheet

EXHAUST GAS RECIRCULATION DEVICE FOR A MOTOR VEHICLE

CROSS REFERENCE TO RELATED APPLICATION

This application claims priority to German Patent Application No. 102013003458.2 filed Mar. 1, 2013, which is incorporated herein by reference in its entirety.

TECHNICAL FIELD

The technical area relates to exhaust gas recirculation devices for a motor vehicle with an unburnt gas line for guiding an unburnt gas flow and at least one exhaust gas feed line for supplying exhaust gas into the unburnt gas line. In addition, the technical area relates to engines with such an exhaust gas recirculation device.

BACKGROUND

Known from practice are exhaust gas recirculation devices that exhibit a mixing unit for mixing unburnt gas for an internal combustion engine and exhaust gas of the internal combustion engine, which is situated upstream from a turbocharger or compressor chamber of the turbocharger. Known exhaust gas recirculation devices provide an unburnt gas line extending to the compressor chamber of the turbocharger to the unburnt gas flow. In order to mix the unburnt gas with an exhaust gas, at least one exhaust gas feed line is further provided to feed exhaust gas into the unburnt gas line. The exhaust gas feed line laterally empties into the unburnt gas line, wherein the exhaust gas inside the unburnt gas line mixes with the unburnt gas.

SUMMARY

The object in one embodiment of the present disclosure is to provide an exhaust gas recirculation device for a motor vehicle that enables an improved mixing of the exhaust gas and unburnt gas, so as to avoid local temperature peaks, and thus prevent coking and potential material damage to components following in the direction of flow, for example the compressor wheel of a turbocharger. In another aspect of the present disclosure, the object is to provide an engine with such an exhaust gas recirculation device, by means of which the aforementioned advantages are achieved.

In one embodiment an exhaust gas recirculation device for a motor vehicle exhibits an unburnt gas line for guiding an unburnt gas flow. In addition, the unburnt gas line has allocated to it at least one exhaust gas feed line to feed exhaust gas into the unburnt gas line. As a consequence, the exhaust gas fed into the unburnt gas line via the exhaust gas feed line can blend with the unburnt gas inside the unburnt gas line. The exhaust gas recirculation achieved by the exhaust gas recirculation device preferably involves a so-called low-pressure exhaust gas recirculation. The unburnt gas line or unburnt gas line wall preferably incorporates two, preferably at least three, discharge openings. The discharge openings are offset relative to each other in the circumferential direction of the unburnt gas line. For example, the discharge openings can here be flush with each other in the circumferential direction and/or offset relative to each other in the longitudinal direction of the unburnt gas line. However, the discharge openings can also be offset relative to each other in the longitudinal direction to such an extent as not to be flush with each other in the circumferential direction. The discharge openings preferably involve discharge openings designed separately from each other. The exhaust gas of the unburnt gas line supplied via the exhaust gas feed line can be or is supplied via the mentioned discharge openings, so that the exhaust gas can blend with the unburnt gas inside the unburnt gas line.

The at discharge openings in the unburnt gas line offset relative to each other in the circumferential direction of the unburnt gas line yield a good and uniform blending of the exhaust gas with the unburnt gas inside the unburnt gas line. Impermissibly high local temperatures in or on ensuing components of the exhaust gas recirculation device are avoided in this way. This makes it possible to especially reliably prevent oil from coking and deposits from baking on ensuing components, for example the rotor assembly or compressor wheel of an ensuing turbocharger compressor. The good and uniform blending of the exhaust gas and unburnt gas inside the unburnt gas line also results in an especially high exhaust gas recirculation rate. The flow of unburnt gas inside the unburnt gas line is only slightly influenced due to the use of simple discharge openings in the unburnt gas line as opposed to solutions, in which the exhaust gas feed line extends into the unburnt gas flow inside the unburnt gas line, so that the flow toward an ensuing component inside the exhaust gas recirculation device, for example the compressor wheel of a turbocharger compressor, can be uniform and largely devoid of turbulence.

In an embodiment of the exhaust gas recirculation device, the unburnt gas line is situated in a housing, forming an annular space or annularly segmented space enveloping the unburnt gas line, wherein the exhaust gas feed line empties into the housing, and is connected in terms of flow with the discharge openings via its annular space or annularly segmented space. On the one hand, this simplifies the structural design and manufacture of the exhaust gas recirculation device. A separate exhaust gas feed line need not be allocated to each of the discharge openings; the exhaust gas supplied via the unburnt gas feed line can rather be distributed to the discharge openings via the annular space or annularly segmented space. For example, given a space that is continuous in a circumferential direction, i.e., an annular space, only one exhaust gas feed line need be allocated to this annular space. By contrast, given a space interrupted in the circumferential direction, i.e., an annularly segmented space, only one exhaust gas feed line need be allocated to this annularly segmented space. In the event of two or more annularly segmented spaces that follow each other in the circumferential direction, but are separated from each other, an exhaust gas feed line need be allocated only to each individual annularly segmented space. On the other hand, it was shown that liquid contained in the unburnt gas flow or exhaust gas condenses less strongly inside the unburnt gas line, but rather outside the unburnt gas line, specifically inside the annular space or annularly segmented space, in particular at low operating temperatures or outside temperatures. This reduces the danger that condensate will be introduced into an ensuing component, for example a turbocharger compressor, making it possible to avoid a so-called water hammer on the compressor wheel or the like. It has proven effective in this conjunction for the housing to be provided with means for removing the condensate from the annular space or annularly segmented space.

When using at least one annularly segmented space, one embodiment of the exhaust gas recirculation device provides at least two annularly segmented spaces that follow each other in the circumferential direction, but are separated from each other. In this way, the exhaust gas supplied via the exhaust gas feed lines can be distributed over approximately the entire circumference of the unburnt gas line, so as to achieve an especially good blending with the unburnt gas.

If an annularly segmented space is provided instead of a space continuous in the circumferential direction, i.e., an annular space, it exhibits a wrap-around angle of more than 90°, preferably of at least 120°, relative to the unburnt gas line in another embodiment of the exhaust gas recirculation device, so as to achieve a reliable distribution of exhaust gas over the circumference of the unburnt gas line, and hence an especially good blending of the exhaust gas with the unburnt gas via the discharge openings allocated to the annularly segmented space.

In another embodiment of the exhaust gas recirculation device, the unburnt gas line exhibits a first circumferential section that is aligned flush with the exhaust gas feed line. As a result, the exhaust gas entering the annular space or annularly segmented space via the exhaust gas feed line hits the first circumferential section, and is thereby reliably distributed inside the annular space or annularly segmented space in the circumferential direction. In this embodiment, it could also be said that the first circumferential section of the unburnt gas line is situated opposite an outlet opening of the exhaust gas feed line, so as to bring about the addressed distribution of the exhaust gas inside the annular space or annularly segmented space. Finally, the good distribution of exhaust gas inside the annular space or annularly segmented space causes the exhaust gas to blend especially well with the unburnt gas via the discharge openings in the unburnt gas line allocated to the annular space or annularly segmented space. It further proved beneficial in this embodiment for the exhaust gas feed line to extend in a radial direction, possibly concentrically, relative to the unburnt gas line. However, the exhaust gas feed line can alternatively also empty tangentially into the annular space or annularly segmented space, so as to bring about the addressed reliable distribution of exhaust gas inside the annular space or annularly segmented space, and hence a good blending of the exhaust gas with the unburnt gas.

In order to prevent the exhaust gas exiting the exhaust gas feed line and entering the annular space or annularly segmented space from getting into the unburnt gas flow right away, without the exhaust gas having been uniformly distributed within the annular space or annularly segmented space, the exhaust gas recirculation device in the first circumferential section of the unburnt gas line allocated to the outlet opening of the exhaust gas feed line is in another embodiment provided with no discharge openings, or just with discharge openings having a flow cross section smaller than the flow cross section of at least one, preferably all, of the discharge openings in another circumferential section of the unburnt gas line.

As already indicated above, the annular space or the one or more annularly segmented spaces can each have allocated to them only one exhaust gas feed line. In order to here ensure that approximately the same amount of exhaust gas is supplied to the unburnt gas line via the respective discharge openings allocated to the annular space or annularly segmented space regardless of the distance in the circumferential direction to the outlet opening of the respective exhaust gas feed line, thereby achieving a good and uniform blending of exhaust gas and unburnt gas, another embodiment of the exhaust gas recirculation device provides at least one, preferably all, of the discharge openings in a second circumferential section of the unburnt gas line, which in the circumferential direction is situated closer to the first circumferential section than a third circumferential section of the unburnt gas line, with a smaller flow cross section than at least one, preferably all, of the discharge openings in the third circumferential section. For example, the circumferential sections can here be aligned flush with each other in the circumferential direction and/or offset relative to each other in the longitudinal direction of the unburnt gas line. However, it is also possible for the circumferential sections to be offset relative to each other in the longitudinal direction of the unburnt gas line to such an extent as not to be aligned flush with each other in the circumferential direction.

In another embodiment of the exhaust gas recirculation device representing a special variant of the embodiment described above, the respective flow cross section of the discharge openings in the unburnt gas line becomes larger the more remote or spaced apart it is from the first circumferential section in the circumferential direction.

The aforementioned discharge openings mentioned above can basically exhibit any shape desired. However, it has proven beneficial in terms of both flow and production technology for the flow cross section of the discharge openings to be circular, as is the case in another embodiment of the exhaust gas recirculation device.

In another embodiment of the exhaust gas recirculation device, at least one row of discharge openings aligned flush with each other or one after the other is provided in the unburnt gas line. This not only improves the blending of exhaust gas and unburnt gas, but rather also simplifies the manufacture of the unburnt gas line along with the discharge openings provided therein.

In order to achieve a reliable and uniform blending of exhaust gas and unburnt gas, another embodiment of the exhaust gas recirculation device provides at least two rows of the aforementioned kind spaced apart from each other in the longitudinal direction of the unburnt gas line. In this way, the exhaust gas and unburnt gas can be blended over a larger longitudinal section of the unburnt gas line, yielding an improved blending.

In another embodiment of the exhaust gas recirculation device in which the unburnt gas line incorporates at least two rows that are spaced apart from each other in the longitudinal direction of the unburnt gas line and having discharge openings aligned flush with each other in the circumferential direction, the discharge openings in the first row align flush in the longitudinal direction of the unburnt gas line with discharge interstices between the discharge openings in the adjacent other row, so that the exhaust gas can blend with the unburnt gas not just over a larger longitudinal section of the unburnt gas line, but also over an overall larger circumferential area of the unburnt gas line, resulting in a good or uniform blending of exhaust gas and unburnt gas.

In another embodiment of the exhaust gas recirculation device, the unburnt gas line is secured to the housing with an inlet and/or outlet flange so as to reliably form the annular space or annularly segmented space and reliably guide the unburnt gas inside the unburnt gas line. It is here preferred that the inlet and/or outlet flange be designed separately from the unburnt gas line and/or housing to simplify the manufacture of the exhaust gas recirculation device. In order to achieve an advantageous combination of functions and thus also avoid a plurality of parts, it is especially preferred that the inlet and/or outlet flange be designed not just to secure the unburnt gas line to the housing, but also to border and/or seal the annular space or annularly segmented space. The annular space or annularly segmented space is preferably bordered and/or sealed in the longitudinal direction of the unburnt gas line by the inlet and/or outlet flange. For sealing purposes, it is further preferred that this take place by interspersing a gasket between the housing on the one hand and the inlet and/or outlet flange on the other.

In another embodiment of the exhaust gas recirculation device, the outlet flange for securing the unburnt gas line to the housing is formed by a housing section of a turbocharger on the compressor side. In other words, the outlet flange formed by the housing section of a turbocharger on the compressor side acts on the one hand to secure the unburnt gas line to the housing, if necessary bordering the annular space or annularly segmented space, and on the other hand to border the compressor-side area of a turbocharger. This not only reduces the plurality of parts and simplifies the structural design of the exhaust gas recirculation device, instead the unburnt gas line can be situated relatively tightly against the compressor side of the turbocharger. The advantage to this is that the volume of the intake system of the internal combustion engine can be diminished, as a result of which the transient response characteristic of the internal combustion engine can be improved.

In another embodiment of the exhaust gas recirculation device, the outlet flange formed by the housing section of the turbocharger on the compressor side can border or borders or can seal or seals a compressor chamber for accommodating a compressor wheel of the turbocharger.

In another embodiment of the exhaust gas recirculation device, the compressor-side housing section that forms the outlet flange can be secured or is secured to another housing section of the turbocharger, preferably another housing section of the housing bordering the compressor chamber of the turbocharger. For example, corresponding means for achieving a bolted connection between the compressor-side housing section and other housing section of the turbocharger could be provided for this purpose, e.g., threaded or screwed holes.

In another embodiment of the exhaust gas recirculation device, the inlet and/or outlet flange incorporates a feed or delivery opening connected in terms of flow with the unburnt gas line in order to prevent unburnt gas or mixed gas from entering or exiting the unburnt gas line.

In order to achieve a largely turbulence-free and uniform unburnt gas flow and/or mixed gas flow as the unburnt gas enters the unburnt gas line and/or the unburnt gas mixed with the exhaust gas exits the unburnt gas line, the unburnt gas line is arranged on the inlet and/or outlet flange in another embodiment of the exhaust gas recirculation device, yielding a constant flow cross section in the transitional region between the unburnt gas line on the one hand and the feed or delivery opening on the other. Both the shape of the flow cross section and its size should here be constant. As an alternative, an at least continuous transition can also be provided in the transitional region between the unburnt gas line on the one hand and the feed or delivery opening on the other.

In order to simplify the manufacture of the exhaust gas recirculation device and positioning of the unburnt gas line on the inlet and/or outlet flange, the inlet and/or outlet flange is provided with a recess into which the unburnt gas line can be inserted or is inserted, whether directly clamped and/or interspersing a gasket. In this case, a gasket would prevent the exhaust gas from mixing with the unburnt gas in any interstices that might remain between the unburnt gas line on the one hand and the inlet and/or outlet flange on the other, but rather do so exclusively and specifically via the aforementioned discharge openings in the unburnt gas line.

In order to simplify the manufacture of the exhaust gas recirculation device, achieve a constant volume inside the unburnt gas line, and reach a constant volume for the annular space or annularly segmented space, the unburnt gas line is formed by a possibly rigid pipe in another embodiment of the exhaust gas recirculation device. For example, if the discharge openings are provided in the wall of the pipe, the discharge openings can here be designed like discharge openings or boreholes generated by drilling, so as to further simplify the manufacture of the unburnt gas line.

In order to control and/or regulate the quantity of exhaust gas to be mixed with the unburnt gas, another embodiment of the exhaust gas recirculation device provides at least one valve system for controlling and/or regulating the quantity of exhaust gas that can be supplied or is supplied via the exhaust gas feed line. It has here proven beneficial for the valve system to be secured to the housing and/or integrated at least partially into the housing, so as to achieve a compact and modular structural design.

Another embodiment of the present disclosure relates to an engine with an exhaust gas recirculation device of the kind described.

In another embodiment of the engine, the engine exhibits a low-pressure exhaust gas recirculation unit (ND-AGR).

BRIEF DESCRIPTION OF THE DRAWINGS

The present disclosure will hereinafter be described in conjunction with the following drawing figures, wherein like numerals denote like elements, and.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1:
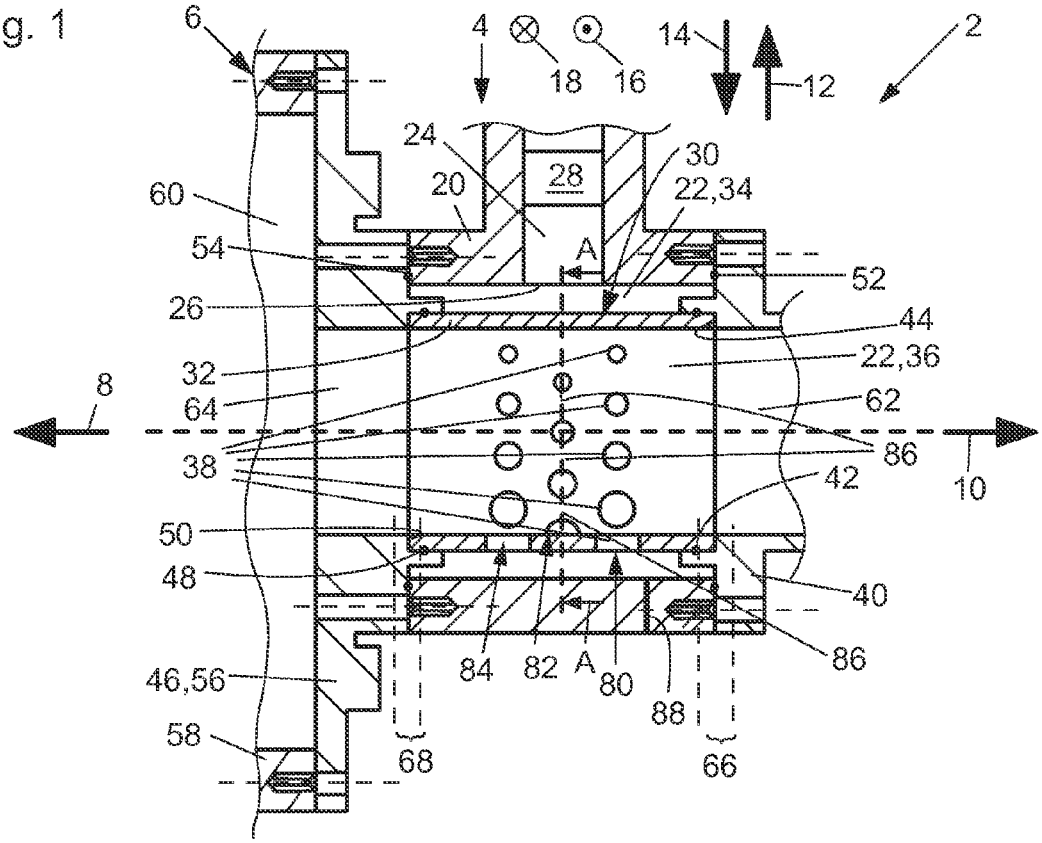
FIG. 1 is a partial, sectional side view depicting an embodiment of the exhaust gas recirculation device.

FIG. 1 shows a partial view depicting an embodiment of the exhaust gas recirculation device 2. In particular a mixing device 4 and compressor side 6 of a turbocharger are presented on FIG. 1. Corresponding arrows are used on FIG. 1 to denote the mutually opposing longitudinal directions 8, 10, the mutually opposing radial directions 12, 14, and the mutually opposing circumferential directions 16, 18 of the exhaust gas recirculation device 2, or the unburnt gas line of the exhaust gas recirculation device 2 to be described in more detail later.

The mixing device 4 exhibits a housing 20, which preferably is designed as a cast part. The housing 20 envelops an interior space 22 that is continuous in the longitudinal directions 8, 10. The wall of the housing 20 incorporates at least one exhaust gas feed line 24, which can be supplied with exhaust gas on the one hand, and laterally empties into the interior space 22 of the housing 20 via an inlet opening 26 on the other. The exhaust gas feed line 24 here extends in a radial direction 12, 14 and concentrically to the interior space 22 or to the unburnt gas line inside the interior space 22 to be described in more detail later. In addition, the housing 20 also has secured to it a valve unit 28 only denoted schematically, which serves to control and/or regulate the quantity of exhaust gas that can be supplied or is supplied into the interior space 22 via the exhaust gas feed line 24 and inlet opening 26. As evident from FIG. 1, the valve unit 28 is at least partially integrated into the housing 20 or exhaust gas feed line 24, so as to achieve an especially compact structural design for the mixing device 4.

Situated inside the interior space 22 is an unburnt gas line 30 extending in the longitudinal directions 8, 10 for guiding an unburnt gas or unburnt gas stream. The unburnt gas line 30 is open in longitudinal direction 8 on the one hand, and in longitudinal direction 10 on the other, so that the unburnt gas can flow through the unburnt gas line 30. In the embodiment shown, the unburnt gas line 30 is formed by a rigid pipe 32, which is situated in the interior space 22 of the housing 20, creating an annular space 34 enveloping the unburnt gas line 30 in a radial direction 12, while a mixing space 36 is formed inside the unburnt gas line 30, i.e., in a radial direction 14 inside the pipe 32. In other words, the unburnt gas line 30 divides the interior space 22 of the housing 20 into the annular space 34 and the mixing space 36 lying on the inside in a radial direction 14. The exhaust gas feed line 24 empties into the annular space 34 lying on the outside in a radial direction 12 via the inlet opening 26. In addition, the unburnt gas line 30, more precisely the wall of the pipe 32, is provided with discharge openings 38, so that the exhaust gas feed line 24 is connected in terms of flow with the mixing space 36 inside the unburnt gas line 30 by way of the inlet opening 26, the annular space 34 and the discharge openings 38. The discharge openings 38 will be discussed in more detail again later.

The unburnt gas line 30 is fixed and secured to the housing 20 by an inlet flange 40 designed separately from the unburnt gas line 30 and housing 20. To this end, the pipe 32 forming the unburnt gas line 30 is inserted into a recess 44 in the side of the inlet flange 40 facing in the longitudinal direction 8, while clamped in the longitudinal direction 10 and having a continuous gasket 42 interspersed. By contrast, the inlet flange 40 itself is bolted with the side of the housing 20 facing in the longitudinal direction 10. The unburnt gas line 30 is fixed and secured to the housing 20 by means of an outlet flange 46 designed separately from the unburnt gas line 30 and the housing 20. In this case as well, the pipe 32 forming the unburnt gas line 30 is inserted into a recess 50 facing in the longitudinal direction 10 on the outlet flange 46, while clamped in the longitudinal direction 8 and having a continuous gasket 48 interspersed. The outlet flange 46 is in turn bolted with the side of the housing 20 facing in the longitudinal direction 8, or detachably joined with the housing 20 in some other way. As evident from FIG. 1, the annular space 34 is thus bordered in the longitudinal direction 10 by the inlet flange 40, and in the opposite longitudinal direction 8 by the outlet flange 46. Both the inlet flange 40 and the outlet flange 46 are here supported against the housing 20 with a respective continuous gasket 52, 54 interspersed, so that the annular space 34 is reliably sealed, and exhaust gas supplied to the annular space 34 via the exhaust gas feed line 24 can only escape the annular space 34 and get into the mixing space 36 via the aforementioned discharge openings 38.

In the embodiment shown, the aforementioned outlet flange 46 is formed by a compressor-side first housing section 56. The outlet flange 46 could also be said to be designed as a single piece with the first housing section 56. The first housing section 56 forming the outlet flange 46 is detachably secured to a second housing section 58 of the compressor side 6 of the turbocharger, in the embodiment depicted via a bolted connection denoted on FIG. 1. The first housing section 56 forming the first outlet flange 46 and the second housing section 58 of the compressor side 6 of the turbocharger border a compressor chamber 60, into which the mixed gas can flow, and in which a turbocharger compressor wheel not shown in any greater detail can be accommodated or is accommodated.

In order to allow unburnt gas to flow into the mixing space 36 of the unburnt gas line 30 in the longitudinal direction 8 via the inlet flange 40, in the inlet flange 40 a feed opening 62 is provided and connected in terms of flow with the mixing space 36 inside the unburnt gas line 30. So as to further enable the mixed gas to flow in a longitudinal direction 8 from the mixing space 36 inside the unburnt gas line 30 via the outlet flange 46 or first housing section 56 into the compressor chamber 60, the outlet flange 46 or first housing section 56 incorporates a delivery opening 64, which is connected in terms of flow with the mixing space 36 in the unburnt gas line 30 on the one hand, and with the compressor chamber 60 on the other. The pipe 32 forming the unburnt gas line 30 is here arranged on the inlet flange 40, yielding a constant flow cross section in the transitional region 66 between the unburnt gas line 30 on the one hand and the feed opening 62 on the other, while the mentioned pipe 32 is further arranged on the outlet flange 46 or first housing section 56, yielding a constant flow cross section in the transitional region 68 between the unburnt gas line 30 on the one hand and the delivery opening 64 on the other. In other words, not just a flow cross section having a constant size, but also a cross section having an identical shape, is achieved in the transitional regions 66, 68. As an alternative, however, the flow cross sectional size and/or the flow cross sectional shape can also be modified in the transitional regions 66, 68; given such a case, however, at least a continuous transition should be provided in the transitional regions 66, 68.

Figure 2:
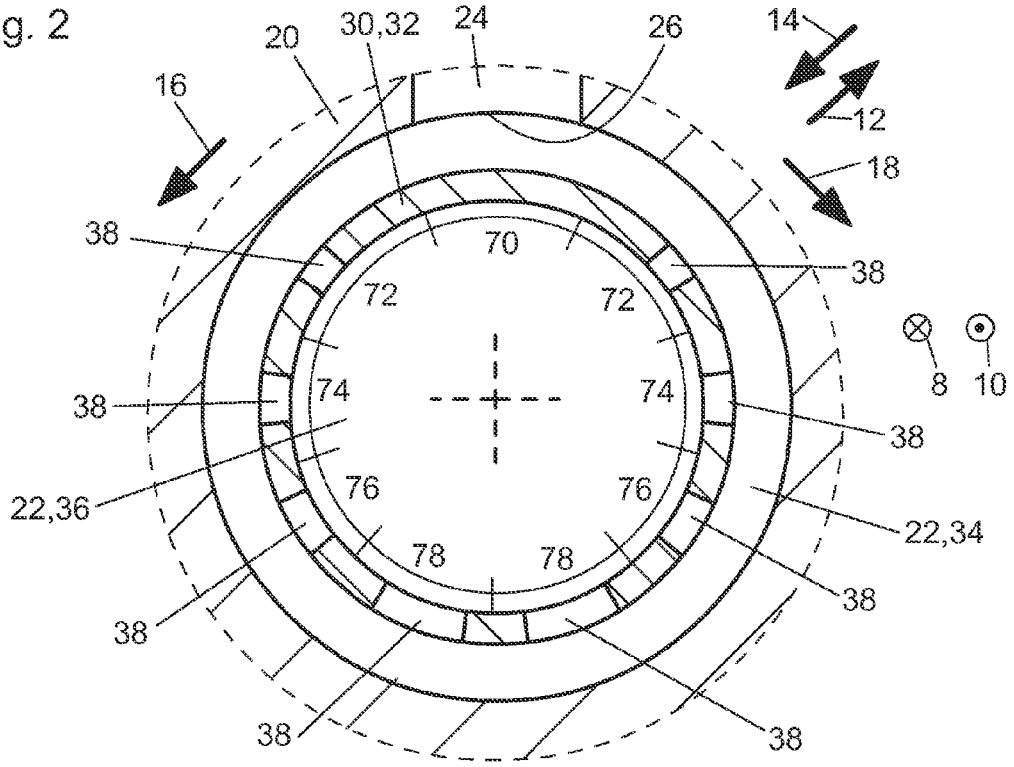
FIG. 2 is a magnified sectional view along the intersecting line A-A of FIG. 1.

As evident from FIGS. 1 and 2, at least two discharge openings 38 offset relative to each other in the circumferential direction 16, 18 of the unburnt gas line 30 are provided in the wall of the pipe 32 forming the unburnt gas line 30 in the exhaust gas recirculation system 2, by way of which the exhaust gas that was introduced into the annular space 34 via the exhaust gas feed line 24 can be supplied or is supplied to the mixing space 36 of the unburnt gas line 30 inwardly in a radial direction 14. The pipe 32 forming the unburnt gas line 30 exhibits a first circumferential section 70 that outwardly faces the inlet opening 26 of the exhaust gas feed line 24 in a radial direction, and thus is aligned flush with the exhaust gas feed line 24 or inlet opening 26 of the exhaust gas feed line 24 in a radial direction 12, 14. As evident from FIGS. 1 and 2, the first circumferential section 70 is not provided with any discharge openings 38. While the first circumferential section 70 could alternatively be provided with discharge openings 38, they would then exhibit a flow cross section smaller than the flow cross section for at least one, preferably all, of the discharge openings 38 in another circumferential section of the pipe 32 forming the unburnt gas line 30.

In addition, the pipe 32 forming the unburnt gas line 30 exhibits two circumferential sections 72, which are situated closer to the first circumferential section 70 in the circumferential direction 16, 18 than the third circumferential section 74 of the pipe 32 forming the unburnt gas line 30, wherein the discharge openings 38 in the second circumferential sections 72 exhibit a smaller flow cross section, i.e., in particular a smaller cross sectional size, than the discharge openings 38 in the third circumferential sections 74. The same also holds true for the other circumferential sections denoted on FIG. 2, specifically the fourth circumferential sections 76 and the fifth circumferential sections 78. In the embodiment shown, the flow cross section, i.e., in particular the cross sectional size, of the discharge openings 38 increases the further away the latter are located from the first circumferential section 70 in the circumferential direction 16, 18. In addition, the flow cross sections for all discharge openings 38 are circular in the depicted embodiment, preferably designed as boreholes.

In order to achieve an especially uniform and good blending of exhaust gas and unburnt gas inside the mixing space 36 of the unburnt gas line 30 over a larger longitudinal area of the unburnt gas line 30, the wall of the pipe 32 forming the unburnt gas line 30 is provided with rows 80, 82, 84 spaced apart in the longitudinal direction 8, 10, having discharge openings 38 in the wall of the pipe 32 forming the unburnt gas line 30 that are aligned flush with each other in the circumferential direction 16, 18 and arranged one after the other. In this sequential arrangement, in order not just to blend the exhaust gas with the unburnt gas by way of a mixing region elongated in the longitudinal direction 8, 10, but also to achieve a good and uniform blending in relation to the circumference of the unburnt gas line 30, the discharge openings 38 in the one row, e.g., row 80, are arranged flush and one after the other in the longitudinal direction 8, 10, with discharge interstices 86 between the discharge openings 38 of the adjacent other row, e.g., row 82, as may be gleaned in particular from FIG. 1.

The function of the exhaust gas recirculation device 2 along with other or alternative features relating thereto will be described below, drawing reference to FIGS. 1 and 2.

During operation of the internal combustion engine of the motor vehicle (not shown in any more detail), unburnt gas flows through the feed opening 62 into the mixing space 36 inside the unburnt gas line 30, and further proceeds in a longitudinal direction 8 from the unburnt gas line 30 as a mixed gas consisting of unburnt gas and exhaust gas via the delivery opening 64 into the compressor chamber 60 of the turbocharger compressor side 6, so as to be compressed by the compressor wheel (not shown in any more detail) inside the compressor chamber 60, and then supplied to the internal combustion engine for purposes of combustion. Parallel hereto, exhaust gas is supplied in a radial direction 14 through the exhaust gas feed line 24 into the annular space 34 within the framework of supplying low-pressure exhaust gas. The quantity of exhaust gas supplied to the annular space 34 via the exhaust gas feed line 24 is here controlled and/or regulated by the aforementioned valve unit 28. The exhaust gas inside the annular space 34 flows through the discharge openings 38 in the wall of the pipe 32 forming the unburnt gas line 30 and into the mixing space 36 of the unburnt gas line 30, so as to blend with the unburnt gas and yield the aforementioned mixed gas, which continues to flow into the compressor chamber 60 in the longitudinal direction 8.

The described configuration of the mixing arrangement 4 yields an especially good and uniform blending of the exhaust gas and unburnt gas within the mixing space 36. As a result, temperature spikes can be avoided on ensuing components, e.g., the compressor wheel inside the compressor chamber 60, thereby largely preventing oil from coking and deposits from baking on the ensuing component or compressor wheel. In other words, material damages to the ensuing component or compressor wheel can be avoided. Achieved as well is a largely turbulence-free and uniform flow of unburnt gas and mixed gas through the feed opening 62, the mixing space 36 and delivery opening 64, especially since the latter are not negatively influenced in either the transitional regions 66, 68 or by the discharge openings 38. The good and uniform blending and flow enables a high exhaust gas return rate, and a reliable function of the ensuing components or compressor wheel inside the compressor chamber 60.

It has additionally been found that liquid inside the supplied unburnt gas or exhaust gas increasingly condenses on the side of the pipe 32 forming the unburnt gas line 30 that faces outwardly in the radial direction 12 or inside the annular space 34 at low operating temperatures and ambient temperatures, and thus does so only to a diminished extent if at all on the side of the pipe 32 forming the unburnt gas line 30 that faces inwardly in the radial direction 14 or in the mixing space 36, as a result of which less liquid gets into the compressor chamber 60, wherein this would lead to a disadvantageous water hammer on the compressor wheel. This allows the compressor wheel to function reliably and without causing damage inside the compressor space 60. In order to remove condensate accruing in the annular space 34 from the annular space 34, corresponding means 88 for removing the condensate or liquid from the annular space 34 can be provided, as schematically indicated on FIG. 1. However, these means 88 should be designed in such a way that removing condensate or liquid from the annular space 34 during normal operation of the internal combustion chamber does not also cause exhaust gas from being removed from the annular space 34, wherein controlling and/or regulating means 88 for removing the condensate or liquid from the annular space 34 can be provided for this purpose, for example.

The embodiment of the exhaust gas recirculation device 2 described above provides the annular space 34 enveloping the unburnt gas line 30, and hence a space 34 that is continuous or closed in the circumferential direction 16, 18. This is advantageous, but not absolutely necessary. In an embodiment not depicted in any greater detail and otherwise corresponding to the embodiment described above, an annularly segmented space can be provided in place of the annular space 34. In such a case, the annularly segmented space should exhibit a wrap-around angle relative to the unburnt gas line 30 that exceeds 90°, preferably measuring at least 120°, so as to be able to achieve as many discharge openings 38 as possible that are spaced apart in the circumferential direction 16, 18 and offset relative to each other. Two or more annularly segmented spaces that follow each other in the circumferential direction 16, 18 but are separated from each other can also be provided in place of the annular space 34. Using one or more annularly segmented spaces separated from each other, by way of which the exhaust gas can be fed from the exhaust gas feed line 24 to the discharge openings 38, has proven effective particularly in cases where supporting the pipe 32 forming the unburnt gas line 30 in a radial direction 12, 14 against the housing 20 is done additionally or alternatively to the inlet flange 40 and/or outlet flange 46 via projecting noses on the side of the housing 20 facing the interior space 22 in a radial direction 14 and/or via noses outwardly projecting in a radial direction 12 on the side of the pipe 32 forming the unburnt gas line 30 facing outwardly in the radial direction 12. For example, supporting ribs extending in the longitudinal direction 8, 10 can be provided for supporting the unburnt gas line 30 in a radial direction 12, 14, which divide the aforementioned annular space 34 into one or more of the aforementioned annularly segmented spaces. In the case of several annularly segmented spaces, care should be taken to allocate a respective exhaust gas feed line in the sense of exhaust gas feed line 24 of the aforementioned kind to each of the annularly segmented spaces.

Since only one or several exemplary embodiments were described above, let it be clear that essentially a plurality of variations and deviations are possible. Let it further be clear that the described embodiments only represent examples, which do not limit the protective scope, applicability or structural design. The abstract and described embodiments instead only provide the expert with a practical guide, based upon which the expert can arrive at least at one exemplary embodiment. It here goes without saying to the expert that different modifications can be made relative to the function and arrangement of the elements described with reference to the exemplary embodiments, without departing from the scope of the attached claims and their equivalents.

While at least one exemplary embodiment has been presented in the foregoing detailed description, it should be appreciated that a vast number of variations exist. It should also be appreciated that the exemplary embodiment is only an example, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. An exhaust gas recirculation device for a motor vehicle comprising:

a housing having a first inlet port in fluid communication with a first gas feed for supplying an intake gas to the housing, a second inlet port in fluid communication with a second gas feed for supplying a recirculated exhaust gas to the housing, and an exhaust port for exhausting a mixture of the intake and recirculated exhaust gases from the housing; and a mixing device for mixing intake and recirculated exhaust gases, the mixing device having a pipe segment disposed within an interior space of the housing to define a mixing region, the pipe segment having a pipe inlet in fluid communication with the first inlet port, a pipe outlet in fluid communication with the exhaust port and a second gas passage defined between the pipe segment and the housing in fluid communication with the second inlet port, the pipe segment having at least two discharge openings formed therethrough which are offset relative to each other in a circumferential direction of the first gas feed, wherein the first gas feed comprises a first circumferential section which is aligned flush with the second gas feed and the flow cross section of the discharge openings becomes larger the more remote they are from the first circumferential section in the respective circumferential direction.

2. The exhaust gas recirculation device according to claim 1 wherein the second gas passage comprises the pipe segment located within the housing to form an annularly-segmented space surrounding the pipe segment such that the second gas feed discharges into the housing through discharge openings via the annularly-segmented space.

3. The exhaust gas recirculation device according to claim 2, wherein the annularly-segmented space comprises a wrap-around angle of more than 90° relative to the first gas feed.

4. The exhaust gas recirculation device according to claim 3, wherein the annularly-segmented space comprises a wrap-around angle of at least 120° relative to the first gas feed.

5. The exhaust gas recirculation device according to claim 2 wherein the first gas feed is secured to the housing with an inlet flange, wherein the inlet flange borders the annularly-segmented space in the longitudinal direction of the first gas feed.

6. The exhaust gas recirculation device according to claim 5, wherein an outlet flange is formed by an exhaust-side housing section.

7. The exhaust gas recirculation device according to claim 5 wherein the mixing device provides a constant flow cross section in the mixing region between the first gas port on the one hand and the second gas port or the exhaust port on the other hand.

8. The exhaust gas recirculation device according to claim 7, wherein the pipe segment is positioned between recesses formed on the inlet flange and the outlet flange, respectively.

9. The exhaust gas recirculation device according to claim 1, wherein the first circumferential section comprises discharge openings with a flow cross section not larger than a flow cross section of at least one discharge opening in a second circumferential section.

10. The exhaust gas recirculation device according to claim 1, wherein the first circumferential section comprises discharge openings with a flow cross section not larger than a flow cross section of all discharge openings in a second circumferential section.

11. The exhaust gas recirculation device according to claim 1, wherein at least one discharge opening in the second circumferential section in which the circumferential direction is situated closer to the first circumferential section than a third circumferential section and further comprises a smaller flow cross section than at least one discharge openings in the third circumferential section.

12. The exhaust gas recirculation device according to claim 11 wherein at least one discharge openings in the second circumferential section and further comprises a smaller flow cross section than all of the one discharge openings in the third circumferential section.

13. The exhaust gas recirculation device according to claim 1 wherein discharge openings are aligned in at least one row flush with each other in the circumferential direction of the first gas feed.

14. The exhaust gas recirculation device according to claim 1, wherein at least two rows of discharge openings are spaced apart from each other in the longitudinal direction of the first gas feed and the discharge openings of the one row is arranged flush with discharge interstices between discharge openings of an adjacent row.

15. The exhaust gas recirculation device according to claim 1, wherein the pipe segment comprises a rigid pipe with the discharge openings formed through a wall thereof.

16. The exhaust gas recirculation device according to claim 1 further comprising a valve unit for regulating a quantity of exhaust gas supplied via the second gas feed.

17. The exhaust gas recirculation device according to claim 16 wherein the valve unit is secured to the housing.

18. The exhaust gas recirculation device according to claim 16 wherein the valve unit is at least partially integrated into the housing.

* * * * *